United States Patent [19]

Edwards

[11] 4,220,082

[45] Sep. 2, 1980

[54] PRINT WHEEL SELECTION MECHANISM

[75] Inventor: Richard A. Edwards, Alameda, Calif.

[73] Assignee: Esselte Pendaflex Corporation, Garden City, N.Y.

[21] Appl. No.: 35,636

[22] Filed: May 3, 1979

[51] Int. Cl.[3] ..... B41J 1/44

[52] U.S. Cl. ..... 101/93.22; 101/99; 101/110

[58] Field of Search ..... 101/93.22, 95, 96, 99, 101/110; 235/60 P, 432, 58 P

[56] References Cited

U.S. PATENT DOCUMENTS

| | | | |
|---|---|---|---|
| 2,896,845 | 7/1959 | Hansen et al. | 235/132 |
| 2,966,843 | 1/1961 | Eckley | 101/110 |
| 3,168,035 | 2/1965 | Jablonski | 101/110 |
| 3,261,283 | 7/1966 | Vroom et al. | 101/95 |
| 3,517,612 | 6/1970 | Stucchi | 101/99 |
| 3,565,334 | 2/1971 | Reynolds | 235/61 |
| 3,669,016 | 6/1972 | Kittel | 101/110 |
| 3,690,250 | 9/1972 | Bremner et al. | 101/95 |
| 3,730,085 | 5/1973 | Beck | 101/95 X |
| 3,732,812 | 5/1973 | Bremner | 101/99 |
| 3,927,613 | 12/1975 | Nantz | 101/110 |
| 3,965,815 | 6/1976 | Lupkas et al. | 101/91 |
| 3,983,805 | 10/1976 | Perkett et al. | 101/93.22 |

*Primary Examiner*—Edward M. Coven
*Attorney, Agent, or Firm*—Gerald J. Ferguson, Jr.; Joseph J. Baker

[57] ABSTRACT

A print wheel selection mechanism operates to sequentially enter into a plurality of print wheels digits to be printed by initially entering the highest order digit into the lowest order or right-most print wheel or vice versa. During the next sequence, the highest order digit is shifted to the print wheel next to the right-most wheel, and the next order digit is entered into the right-most wheel. In this manner, the foregoing sequences are repeated until the entire number is entered into the print wheels with the number being sequentially entered and shifted along the several print wheels. The mechanism includes a plurality of intermediate stop wheels interdigitally and rotatably mounted on a common shaft with the print wheels, the print wheels and the intermediate stop wheels being urged to rotate in a predetermined direction. The print wheels and the intermediate stop wheels are each provided with stops for limiting the rotation of the next succeeding wheel in an ascending order.

5 Claims, 6 Drawing Figures

208
207
221, 222
226
227
228
225
201, 202
214
215
203
206
213
228
224
210
222
221
202
229
211
216
PULL
PUSH
201
230

PRINT WHEEL SELECTION MECHANISM

BACKGROUND OF THE INVENTION

The present invention generally relates to printing mechanisms, and more particularly a print wheel selection mechanism wherein a plurality of print wheels are sequentially set by an encoder with a angular positions of the several print wheels being shifted from print wheel to print wheel until the angular positions of all of the print wheels have been set.

The invention has particular application in a compact, inexpensive, high-speed desk-top printer that will print optical character reader (OCR) characters on labels or the like. Such a printer has applications in merchandising and inventory control systems. However, in order to find acceptance in these applications, the printer must be reliable and provide good quality printed characters which are readable by an OCR.

Printers employing a plurality of print wheels having characters on their peripheral edges and wherein an inked ribbon and paper are interposed between the print wheels and impact means are known. These printers are capable of providing good quality printed characters of the type required for use with OCRs. The mechanisms for setting the individual print wheels, however, tend to be quite complex. This complexity contributes to both an increase in the manufacturing cost of the printer and a decrease in the reliability of the printer.

SUMMARY OF THE INVENTION

It is therefore an object of the present invention to provide a print wheel selection mechanism which is simple and inexpensive to manufacture.

It is another object of the invention to provide an improved print wheel selection mechanism which can be used in a high-speed desk-top printer as a stationary OCR encoder.

These an other objects of the invention are attained by providing a print wheel selection mechanism having a plurality of print wheels and a like plurality of intermediate stop wheels interdigitally and rotatably mounted on a common shaft. The print wheels and the intermediate stop wheels are urged to rotate in a predetermined direction by a constantly running electric motor. The print wheels and the intermediate stop wheels are each povided with stops for limiting the rotation of the next succeeding wheel in an ascending order. An encoder also having a stop and located adjacent a first one of the intermediate stop wheels sequentially sets the angular positions of each of the plurality of print wheels. A first locking device releasably engages the plurality of intermediate stop wheels to prevent their rotation. The first locking device releases the plurality of intermediate stop wheels after each sequential setting by the encoder and then re-engages the plurality of intermediate stop wheels after the first of the intermediate stop wheels has rotated to engage the encoder stop and each of the remaining ones of the plurality of intermediate stop wheels has rotated to engage the stop of the next preceding print wheel. A second locking device releasably engages the plurality of print wheels to prevent their rotation. The second locking device releases the plurality of print wheels after reach re-engagement of the plurality of intermediate stop wheels by the first locking device and then re-engages the plurality of print wheels after each of the plurality of print wheels has rotated to engage the stop of the next preceding intermediate stop wheel. In this way, the angular position of the plurality of print wheels is sequentially set by the encoder and shifted from print wheel to print wheel via the intermediate stop wheels until the angular positions of all of the print wheels have been sent.

In one preferred embodiment of the invention, the plurality of print wheels and intermediate stop wheels frictionally engage the common shaft which is driven by the electric motor. The first locking device is a solenoid operated bail which releasably engages the outer peripheries of each of the plurality of intermediate stop wheels, and the second locking device is also a solenoid operated bail which releasably engages the outer peripheries of each of the plurality of print wheels.

In a second preferred embodiment of the invention, there is additionally provided a plurality of read wheels equal in number to the plurality of print wheels and a like plurality of second intermediate stop wheels interdigitally and rotatably mounted on a second common shaft with the read wheels, both the read wheels and second intermediate stop wheels being in frictional engagement with the second comman shaft. The electric motor constantly drives the second common shaft in a direction opposite to the predetermined direction of rotation of the print wheels. Each of the plurality of read wheels is in engagement with a corresponding one of the plurality of print wheels at their respective outer peripheries, and each of the second intermediate stop wheels is in engagement with a corresponding one of the first intermediate stop wheels at their respective outer peripheries. The first common shaft on which the first intermediate stop wheels and print wheels are mounted is provided with a key way, and each of the print wheels and first intermediate stop wheels are provided with a plurality of indexing slots matable with the key way. The first and second locking devices in this second preferred embodiment comprises a bi-directional solenoid operated release comb slidable in a passageway formed by the key way and one of the indexing slots to engage the indexing slots of the print wheels and release the intermediate stop wheels in a first position and to engage the indexing slots of the intermediate stop wheels and release the print wheels in a second position. In an intermediate position, the comb engages the indexing slots of both the print wheels and the first intermediate stop wheels.

BRIEF DESCRIPTION OF THE DRAWINGS

Other characteristics and advantages of the invention will appear from the following detailed description which makes reference to the accompanying drawings, in which.

DESCRIPTION OF THE PREFERRED EMBODIMENTS

Figure 1:
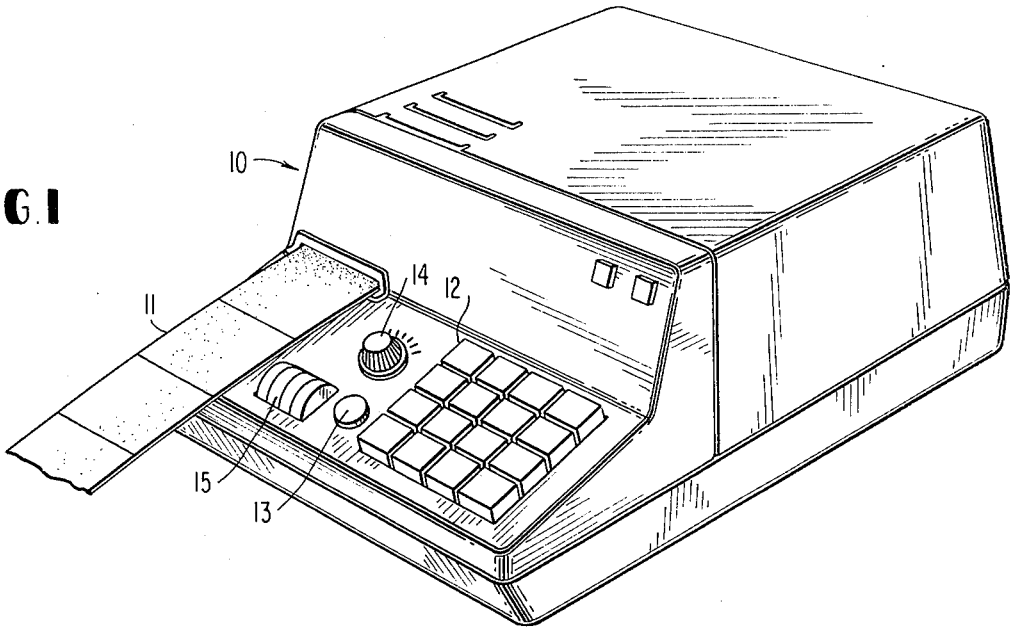
FIG. 1 is a perspective view of an OCR encoder in which the print wheel selection mechanism according to the invention may be used.
Figure 2:
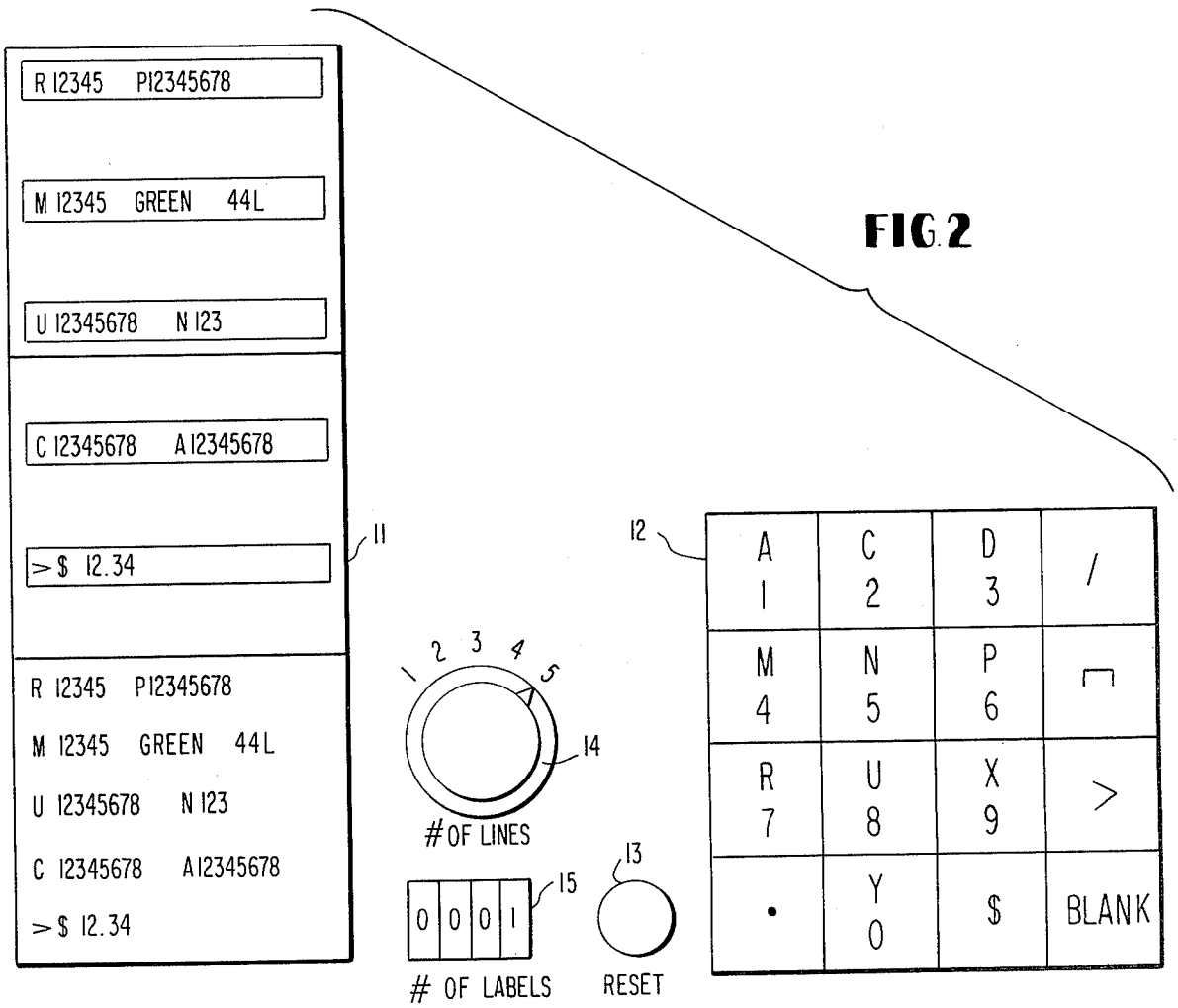
FIG. 2 is a plan view illustrating the key board and controls and an example of printed labels of and produced by the OCR encoder shown in FIG. 1.

Referring now to FIGS. 1 and 2 of the drawings, the print wheel selection mechansim according to the invention is particularly useful in a desk-top printer 10 of the type shown. This printer is designed as a stationary OCR encoder for printing labels or the like generally indicated at 11. The encoder shown is provided with a key board 12 having a four-by-four array of 16 keys. Each of these keys as shown particularly in FIG. 2 may be used to encode an alpha-numeric character to be printed. A reset button 13 is provided for clearing an incorrect entry. Dial 14 selects the number of lines to be printed on each label, while thumb wheels 15 select the number of labels of each type to be printed.

The details of the circuitry for the entry of characters to be printed and the control of the print mechanism forms no part of the present invention and will therefore not be described.

Moreover, the print mechanism itself exclusive of the print wheel selection mechanism which is the subject of this invention but including such components as the inked ribbon, ribbon drive, label feed and hammer mechanism may be entirely conventional and need not be described. The OCR encoder illustrated in FIGS. 1 and 2 is merely exemplary of the type of printer which can use the print wheel selection mechanism of the invention. The invention, however, is not limited to this particular type of printer but may find wider application in other printers of the general type using print wheels once the advantages of the invention owing to its simple, reliable and inexpensive construction are appreciated by those skilled in the art.

Figure 3:
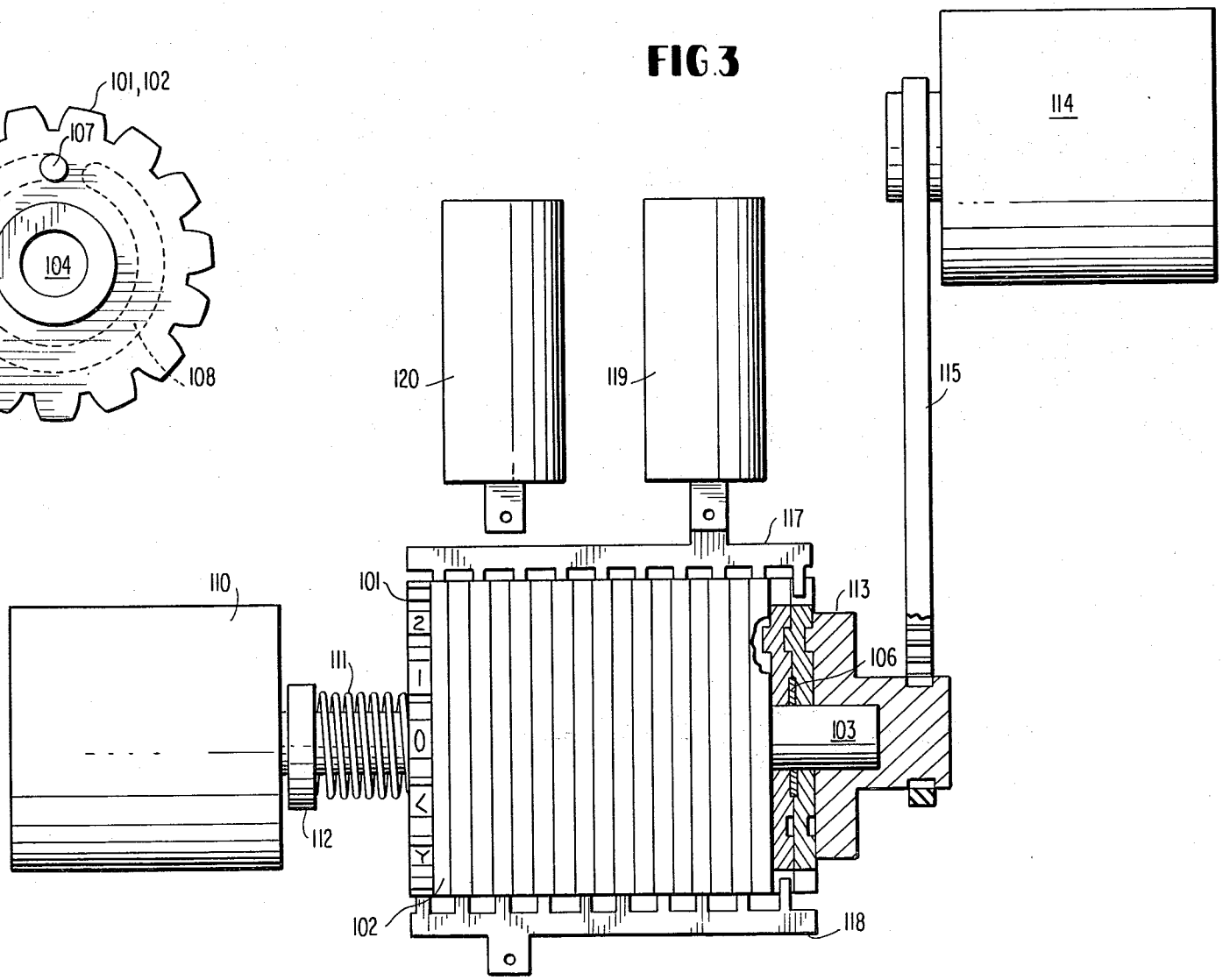
FIG. 3 is a plan view, partially in cross-section, showing a first preferred embodiment of the invention.
Figure 3A:
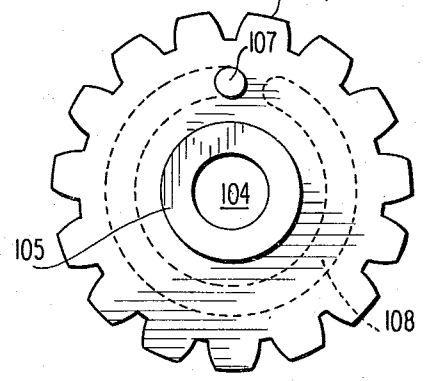
FIG. 3A is a plan view of one of the print wheels or intermediate stop wheels in the embodiment shown in FIG. 3.

Turning now to FIG. 3, ten print wheels 101 and ten intermediate stop wheels 102 are interdigitally and rotatably mounted on a common shaft 103. Each of the print wheels and intermediate stop wheels has the shape shown in FIG. 3A having an aperture 104 for receiving the shaft 103. Surrounding the aperture 104 is a coaxial relief 105 for receiving a friction washer 106 which provides frictional engagement of the wheel with shaft 103. Each print wheel and each intermediate stop wheel is provided with a protrusion 107 on one side of the wheel at a position radially intermediate the relief 105 and the inner most radius of the toothed outer periphery of the wheel. On the opposite side of the wheel, there is provided a circular relief 108 which receives the protrusion 107 of the next preceding wheel. This circular relief is not continuous, that is, an arcuate segment equal to one angular indexing position of the wheel is omitted. As a result, the protrusion 107 of the next preceding wheel will stop the rotation of the wheel having the relief 108 and receiving the protrusion 107 when the end of the relief 108 engages the protrusion 107.

The shaft 103 is driven by a constantly running electric motor 110. This shaft 103 may be directly connected to the shaft of the motor 110, or it may be connected by some transmission such as a belt and pulley drive. As illustrated in FIG. 3, however, shaft 103 is a direct connection to the motor 110. A spring 111 retained by a collar 112 mounted to the motor shaft acts against the face of the left-most print wheel 101 to assure proper frictional engagement between the shaft 103 and each of the several print wheels and intermediate stop wheels.

The angular positions of each of the several print wheels are sequentially set by rotation of the encoder wheel 113. This rotation is provided by means of a stepping motor 114 which is coupled to the encoder wheel 113 by means of a toothed timing belt 115. Again, it would be possible to provide a direct drive between the stepping motor 114 and the encoder wheel 113, but the toothed timing belt 115 provides a convenient and positive coupling which allows some flexibility in the placement of motor 114. The motor 114 is controlled by circuitry (not shown) to stop the encoder wheel 113 sequentially at the desired angular position of each of the print wheels 101.

Although the motor 110 is constantly rotating urging each of the print wheels and intermediate stop wheels to rotate with the shaft 103, these wheels do not ordinarily rotate with the shaft because they are prevented from doing so by bails 117 and 118 which respectively engage the outer toothed peripheries of the intermediate stop wheels and print wheels. Bail 117 is connected to the armature of a soleniod 119 which, when energized, retracts the bail 117 from engagement with each of the ten intermediate stop wheels. Bail 118 is likewise attached to the armature of solenoid 120, but in FIG. 3 bail 118 is shown disconnected from the armature of solenoid 120 and located in the lower most position of the drawing. As a practical matter, bail 118 would ordinarily be located just below bail 117 and slightly displaced angularly to provide the most compact arrangement of the print wheel selection mechanism. As is the case with solenoid 119 when solenoid 120 is energized, it retracts bail 118 from engagement with each of the print wheels 101.

In operation, digits are sequentially entered into the print wheels 101 by initially entering the highest order digit into the right-most print wheel. During the next sequence, the highest order digit is shifted to the print wheel next to the right-most wheel, and the next order digit is entered into the right-most print wheel. In this manner, the foregoing sequences are repeated until the entire number is entered into the print wheels. Thus, not only is the number sequentially entered, but it is also shifted along the several print wheels.

This operation is effected by initially setting the encoder wheel 113 to an angular position corresponding to the highest order digit. The solenoid 119 is then energized to retract the bail 117 from engagement with the intermediate stop wheels 102. Because the shaft 103 is constantly rotating, the right-most intermediate stop wheel now begins to rotate with the shaft 103 and continues to do so until its relief 108 engages the protrusion 107 on the encoder wheel 113. None of the other intermediate stop wheels rotate at this point because their respective reliefs 108 are engaged with the protrusions 107 of the next preceding print wheels. After a time period which is sufficiently long to allow the first or right-most intermediate stop wheel 102 to rotate until it engages the protrusion 107 of the encoder 113, the solenoid 119 is de-energized causing the bail 117 to re-engage the toothed outer peripheries of the intermediate stop wheels 102. At this point in time, the solenoid 120 is energized to cause the bail 118 to be retracted from the toothed outer peripheries of the print wheels with the result that the right-most print wheel will rotate until its relief 108 engages the protrusion 107 of the right-most intermediate stop wheel 102. In this first cycle of operation, none of the remaining print wheels rotate since their respective reliefs 108 are engaged by the protrusions 107 of the next preceding intermediate stop wheels which are now prevented from rotating by the bail 117. After a time sufficient to allow the right-most print wheel to rotate to engagement with the right-most intermediate stop wheel, solenoid 120 is de-energized to cause the bail 118 to re-engage the toothed outer periphery of the print wheels 101.

After the first of the ten digits has been initially set as described above, the second highest digit is entered by again rotating the encoder wheel 113 to the desired angular position. Again, solenoid 119 is energized to retract the bail 117 from the toothed outer peripheries of the intermediate stop wheels 102. As before, the right-most intermediate stop wheel rotates until it engages the protrusion 107 on the encoder wheel 113, but this time the second intermediate stop wheel also rotates until it engages the protrusion 107 on the right-most print wheel. Solenoid 119 is again de-energized so that bail 117 re-engages the toothed outer peripheries of the intermediate stop wheels 102. Then the solenoid 120 is energized to retract the bail 118 from the toothed outer peripheries of the print wheels 101 thereby allowing the first two print wheels to rotate until they respectively engage the protrusion 107 on the next preceding intermediate stop wheels. Solenoid 120 is again de-energized so that the bail 118 re-engages to the toothed outer pripheries of the print wheels 101, and the third cycle is ready to begin. This process continues until all ten digits have been entered with the angular position of each of the print wheels being sequentially set by the encoder wheel 113 and shifted from print wheel to print wheel via the intermediate stop wheels.

Figures 4, 4A:
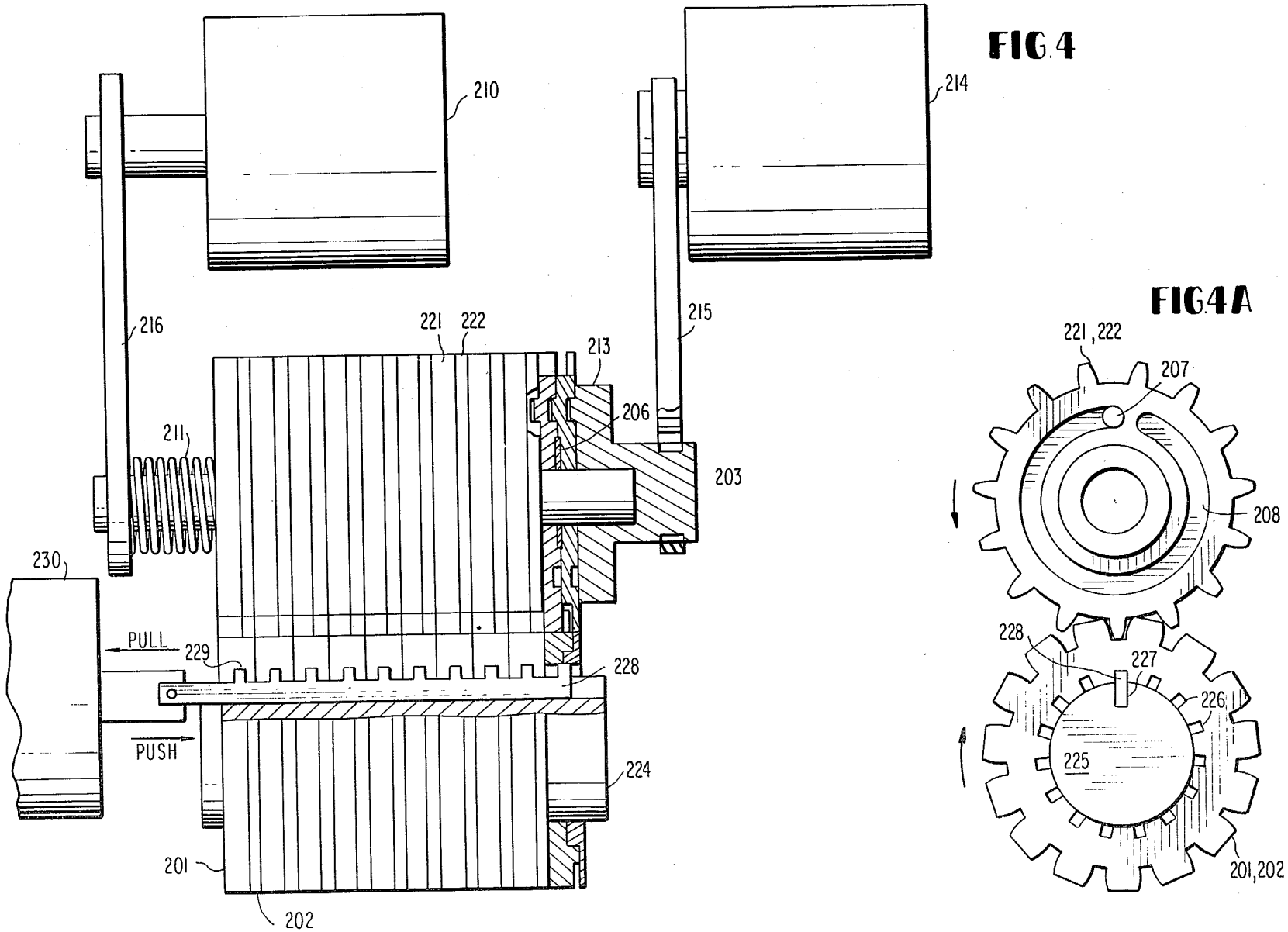
FIG. 4 is a plan view, partially in cross-section, of a second preferred embodiment of the invention.
FIG. 4A is a plan view showing first and second intermediate stop wheels or a read wheel and a print wheel in the embodiment shown in FIG. 4.

A second preferred embodiment of the invention is illustrated in FIG. 4 where, like the first embodiment, a constantly running drive motor 210 is used to drive a shaft 203 and a stepping motor 214 is used to drive an encoder wheel 213 through a toothed timing belt 215. In the embodiment shown in FIG. 4, however, the motor 210 is not directly coupled to the shaft 203. Instead, the motor 201 is coupled to the shaft 203 by a pulley and belt drive 216. The shaft 203 has mounted thereon ten read wheels and ten intermediate stop wheels 22. Like the print wheels and intermediate stop wheels in the first embodiment, these wheels are interdigitally and rotatably mounted on shaft 203 and frictionally engage the shaft by means of friction washers 206 and friction spring 211. FIG. 4A in the upper portion thereof, shows a read wheel 221 or intermediate stop wheel 222, and it will be observed that these wheels are quite similar in construction to the print wheels 101 and intermediate stop wheels 102 of the first preferred embodiment. That is to say, these wheels are each provided with protrusion 207 on one side and a circular relief 208 on the opposite side, the circular relief 208 receiving the protrusion of the next preceding wheel.

As shown in FIG. 4, the second preferred embodiment includes ten print wheels 201 and ten intermediate stop wheels 202 interdigitally and rotatably mounted on a common shaft 224. The shaft 224 is a support shaft, and the print wheels 201 and intermediate stop wheels 202 are freely rotatably thereon. Each of the intermediate stop wheels 202 is in engagement with a corresponding one of the intermediate stop wheels 202 at their respective outer peripheries, and each of the print wheels 201 is in engagement with a corresponding one of the read wheels 221 at their respective outer peripheries. This is best illustrated in FIG. 4A which shows the toothed outer peripheries of intermediate stop wheels 202 and 222 or print wheel 201 and read wheel 221 in engagement with one another. Also as shown in FIG. 4A, the print wheels 201 and intermediate stop are provided with an aperture 225 for receiving the support shaft 224. About the outer edge of this aperture, there are provided a plurality of indexing slots 226 which are designed to mate with a key way 227 in the shaft 224 to provide a passageway for a release comb 228.

Referring back to FIG. 4, this release comb 228 has ten upwardly projecting teeth 229 which project a distance approximately equal to the depth of the indexing slots 226. The main body of the release comb 228 has a depth approximately equal to that of the key way 227 in the support shaft 224. The release comb 228 is attached to the armature of a push pull solenoid 230. This solenoid has a neutral position and two extreme positions. When unenergized, the solenoid 230 assumes the neutral position. The two extreme positions are achieved by energizing one or the other of two field windings. In the right-most position corresponding to a push by the solenoid 230, the teeth of the release comb 228 engage the indexing slots 226 of the intermediate stop wheels 202. On the other hand, in the left-most position corresponding to a pull by the solenoid 230, the teeth 229 of the release comb 228 engage the indexing slots 226 of only the print wheels 201. In the intermediate or neutral position, the teeth 229 of the release comb 228 engage the indexing slots 26 or both the print wheels and intermediate stop wheels 202.

The operation of the second preferred embodiment of the invention shown in FIG. 4 is generally similar to that of the first preferred embodiment shown in FIG. 3. The release comb 228 and push pull solenoid 230, however, replace the bails 117 and 118 and the solenoids 119 and 120. In one cycle of operation, the encoder wheel 213 is set to a desired angular position while the release comb 228 is in its neutral position. After the encoder wheel 213 has been set to a desired angular position, the push pull solenoid 230 is energized to pull the release comb 228 thereby releasing the intermediate stop wheels 202. Since the intermediate stop wheels 222 engage the intermediate stop wheels 202, this also releases intermediate stop wheels 222. As a result, the intermediate stop wheels 222 rotate with the shaft 203 until they engage the protrusion 207 of the next preceding read wheel 221 or, in the case of the right-most intermediate stop wheel 222, the protrusion 207 on the encoder wheel 213. The rotation of the intermediate stop wheels 222 causes a corresponding rotation of the intermediate stop wheels 202 on shaft 224. As shown in FIG. 4A, if the rotation of the intermediate stop wheels 222 produced by the frictional engagement with shaft 203 is in a counter-clockwise direction, the rotation of the intermediate stop wheels 202 is in a clockwise direction. After the intermediate stop wheels 222 and 203 have been rotated, the push pull solenoid 230 is then energized to push the release comb 228 with the result that the print wheels 201 are released and the intermediate stop wheels 202 are prevented from rotating on the support shaft 224. Releasing the print wheels 201 also releases the read wheels 221 on shaft 203. The read wheels 221 therefore rotate with shaft 203 until they engage the protrustion 207 on the next preceding intermediate stop wheel 222. The rotation of the read wheels 221 causes the print wheels 201 to rotate. After the read wheels 221 and print wheels 201 have been rotated, the push pull solenoid 230 is de-energized so that the release comb 228 once again assumes the neutral position preventing both the print wheels 201 and intermediate stop wheels 202 from rotating.

While the invention has been described in terms of two preferred embodiments, those skilled in the art will realize that the invention can be practiced in other and different modifications. Obviously, fewer than ten or more than ten print wheels may be provided, and while digits were set into the print wheels in a sequence preceding from the highest order digit to the lowest order digit, it is a simple matter to reverse the procedure so that digits are entered in a sequence from the lowest order digit to the highest order digit. Also, while the stops between adjacent wheels are illustrated as a protrusion received by a circular relief, protrusions can be disposed on both sides of all of the wheels to accomplish the same objective.

What is claimed is:

1. A print wheel selection mechanism comprising:

a plurality of print wheels and a like plurality of intermediate stop wheels interdigitally and rotatably mounted on a common shaft and means for urging each of said plurality of print wheels and said plurality of intermediate stop wheels to rotate in a predetermined direction, said print wheels and said intermediate stop wheels being provided with stop means for limiting the rotation of the next succeeding wheel, encoder means foe sequentially setting the angular positions of each of said plurality of print wheels, said encoder means including an encoder stop means adjacent a first one of said intermediate stop wheels for limiting the rotation of said first one of said intermediate stop wheels, first locking means for releasably engaging said plurality of intermediate stop wheels to prevent their rotation, said first locking means releasing said plurality of intermediate stop wheels after each sequential setting by said encoder means and re-engaging said plurality of intermediate stop wheels after said first one of said one intermediate stop wheels has rotated to engage said encoder stop means and each of the remainder of said plurality of intermediate stop wheels has rotated to engage the stop means of the next preceding print wheel, and second locking means for releasably engaging said plurality of print wheels to prevent their rotation, said second locking means releasing said plurality of print wheels after each re-engagement of said plurality of intermediate stop wheels by said first locking means and re-engaging said plurality of print wheels after each of said plurality of print wheels has rotated to engage the stop means of the next preceding intermediate stop wheel, whereby each angular position of said plurality of print wheels is sequentially set by said encoder means and shifted from print wheel to print wheel via said intermediate stop wheels until the angular positions of all of said print wheels have been set.

2. The print wheel selection mechanism as recited in claim 1 wherein said plurality of print wheels and said plurality of intermediate stop wheels frictionally engage said common shaft, said means for urging comprising drive means for constantly rotating said common shaft in said predetermined direction, said stop means comprising protrusions on said plurality of print wheels and said plurality of intermediate stop wheels for engaging and limiting the rotation of the next succeeding wheel, and said encoder stop means comprising an encoder wheel having a protrusion for engaging and limiting the rotation of said first one of said plurality of intermediate stop wheels.

3. The print wheel selection mechanism as recited in claim 2, wherein said first locking means comprises a first solenoid operated bail releasably engaging the outer peripheries of each of said plurality of intermediate stop wheels, and said second locking means comprises a second solenoid operated bail releasably engaging the outer peripheries of each of said plurality of print wheels.

4. The print wheel election mechanism as recited in claim 1 further comprising a plurality of read wheels equal in number to said plurality of print wheels and a like plurality of second intermediate stop wheels interdigitally and rotatably mounted on a second common shaft in frictional engagement therewith, each of said plurality of read wheels being in engagement with a corresponding one of said plurality of print wheels at their respective outer peripheries and each of said plurality of second intermediate stop wheels being in engagement with a corresponding one of the first mentioned plurality of intermediate stop wheels at their respective outer peripheries, said means for urging comprising drive means for constantly rotating said second common shaft in a direction opposite said predetermined direction, said stop means for said plurality of print wheels and said first mentioned plurality of intermediate stop wheels comprising protrusions on said plurality of read wheels and said plurality of second intermediate stop wheels, respectively, for engaging and limiting the rotation of the next succeeding wheel, and said encoder stop means comprising an encoder wheel having a protrusion for engaging and limiting the rotating of the first one of said plurality of second intermediate stop wheels.

5. The print wheel selection mechanism as recited in claim 4 wherein said common shaft is provided with a key way and each of said plurality of print wheels and said first mentioned plurality of intermediate stop wheels are provided with a plurality of indexing slots matable with key way to provide a passageway, and said first and second locking means comprise a bi-directional solenoid operated release comb slidable in said passageway formed by said key way and one of said indexing slots to engage the indexing slots of said print wheels and release said first mentioned intermediate stop wheels and a first position and to engage the indexing slots of said first mentioned intermediate stop wheels and release the print wheels in a second position and to engage the indexing slots of both said print wheels and said first mentioned intermediate stop wheels in a position intermediate said first and second positions.

* * * * *